US005241802A

United States Patent [19]

Winterling

[11] Patent Number: 5,241,802

[45] Date of Patent: Sep. 7, 1993

[54] PACKAGE AND METHOD FOR PRODUCING THE SAME

[76] Inventor: Stig Winterling, Yrsnögränd 4, S-126 57 Hägersten, Sweden

[21] Appl. No.: 917,373

[22] Filed: Jul. 23, 1992

[30] Foreign Application Priority Data

Jul. 31, 1991 [SE] Sweden ..... 9102269

[51] Int. Cl.[5] ..... B65B 7/16

[52] U.S. Cl. ..... 53/329.3; 53/376.8; 493/133

[58] Field of Search ..... 493/99, 114, 133, 141, 493/144, 102, 104, 105; 53/329.2, 329.3, 376.6, 376.8

[56] References Cited

U.S. PATENT DOCUMENTS

| | | | |
|---|---|---|---|
| 3,481,527 | 12/1969 | Jacke . | |
| 3,690,091 | 9/1972 | Christensson | 493/102 |
| 3,762,283 | 10/1973 | Renner | 493/102 |
| 4,688,716 | 8/1987 | Winterling . | |
| 4,927,075 | 5/1990 | Lisiecki | 493/102 |

FOREIGN PATENT DOCUMENTS 85019925 2/1989 Sweden .

*Primary Examiner*—Bruce M. Kisliuk
*Assistant Examiner*—Jack Lavinder
*Attorney, Agent, or Firm*—Young & Thompson

[57] ABSTRACT

A package in form of a box for airtightly and liquidtightly containing contents such as liquids is folded from a sheetlike blank. In a first step the box is folded to a tubular sleeve being joint along an lapping joint (7), the box innerside being covered by a liquidtight layer, preferably a plastic material. The box comprises both a lock and a bottom providing folding tongues projecting from each wall at the corresponding ends of the box. A sealing foil (5) is applied over the opening of at least one end of the box, the foil (5) being sealed at both the folding tongues and the box corner portions. The folding tongue or tongues, over which the lapping joint is stretching consists of two tongue parts (9, 10) partly lapping each other. The (10) of these tongue parts (9, 10) lying outside of the other tongue part (9) is provided with a folding edge (6) joining the other tongue part final edge.

1 Claim, 2 Drawing Sheets

PACKAGE AND METHOD FOR PRODUCING THE SAME

The present invention relates to packages being produced of a sheetlike, preferably laminated material and in form of boxes or capsules with a parallelepipedical form. More precisely the invention relates to such a package as being adapted to airtight sealing a product, preferably a liquid, the package being adapted to sustain deepfreezing of its contents and under no circumstances permitting neither leakage of the liquid nor intrusion of foreign matters into it after the package has been sealed.

Packages of this type are used for packaging i.a. juice to be distributed and sold in a frosen condition. Such a package is the is shown in the U.S. Pat. No. 3,481,527 and the Swedish patent 8501992-5.

With this type of package a tubular sleeve with a rectangular or square cross section is folded from a sheetlike blank, the lengthly lapping edge portions are fastened to each other by e.g. gluing, heat sealing or some other kind of method. The sleeve is provided with tongues at its ends to be folded over the open ends in a known way, and thereafter, the open ends, after filling the product into the package, is covered with a foil being provided both airtight and liquidtight on both the final edges in the corners and the inside of the tongues after folding to be covered by the foils, and thus, the package is achieved.

The invention according to the Swedish patent 8501992-5 relates to a reliable seal between the foils and the sleeve corners, where the fastening surface for the foil is comparatively small and where previously existed a risk for leakage and that at the lapping joint is formed during forming of the sleeve itself and especially where this lapping joint is extending over the folding tongues, at which the covering foil is to be fastened in an airtight and liquidtight relation.

For enabling a folding of the package of such a kind quickly and easily from a sheetlike blank and being glued or fastened in some other way this should be performed in an operation without too much precision. Previously, the lapping joint has during the forming of the sleeve itself, i.e. during the first folding and fastening step, been placed near a corner and a longitudinal wall portion edge being placed as accurately as possible into a package box corner, whereas a longitudinal tongue in connection with the adjacent wall portion has its edge ending in an arbitrary position outside of the first mentioned wall portion. In this state the package is entered into the machine for filling of the product and for sealing.

The folding tongue innerside against which the covering foil has to be fastened has become somewhat plane during this first folding and fastening step as long as the precision during folding and gluing has not been too inefficient. In adverse circumstances, however, it has been experienced to be difficult to have the covering foil to seal against the corner edge, the edge in question not being placed in the right position in the corner due to lack of precision.

When the lapping joint is not placed adjacent to a corner for assembling the sleeve, as mentioned above, a channel is obtained of essentially triangular cross section in the corner obtained between the ending edge, the tongue itself and the covering foil, as the foil cannot be pressed into such a corner in an easy and reliable way but will extend over it. This is also what happens, if the above mentioned edge is not placed in the right position in the corner and a similar channel is formed sometimes at the point of the folding tongue, where the transition from single to double material is situated therein, due to that the pressure there has become uneven.

The present invention tries to eleminate the above mentioned problem. This purpose is achieved with a package and a method of producing such a package in accordance with the appertaining claims, of which even the one characterizing the invention appears.

The invention will be described in detail in the following in connection with the enclosed drawings, on which FIG. 1 is a schematic, partly cut cross section of a known embodiment of an lapping joint;

Figure 1:
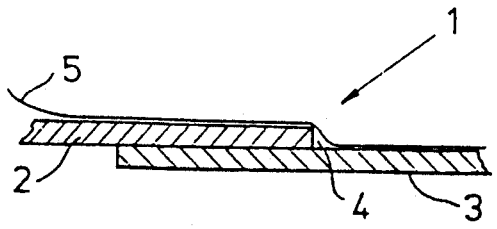

In FIG. 1 a common lapping joint 1 of already known kind is shown, occuring in packages made of a folded and glueconnected sheetlike blank. A tongue part 2 is there glued to another tongue part 3, a corner being achieved at the final edge of the tongue part 2. A covering foil 5 being glued and heatselaed to i.a. the two tongue parts 2 and 3 is streching over the edge 4, a channel being obtained in the corner 4, through which channel liquid and even other materials can leak out of the package. Such a design is not meeting the specifications existing today for an airtight and liquidtight package. As previously mentioned such channels kan exist also in other types of lapping joints.

Therefore the problem is to achieve such an lapping joint that the covering foil can sealingly fasten also on tongues, where the lapping joints are situated, the lapping joint possibly lying in connection to an edge and principially anywhere on the tongue.

During punching of the sheetlike blank for the package also several folding edges are performed, along which the blank has to be folded. During folding along these folding edges an lapping joint 7 is then stretching at each end of the package across a folding tongue 8 as well as along one whole side of the package. Along the package side there is no problem regarding tightness, this problem occuring only, where the covering foils have to be attached for sealingly closing the package ends. The folding tongue 8 consists of two parts 9, 10 which accordingly are lapping each other.

As shown, the tongue part 9 has a fold 11, so that the liquid-tight layer, which the sheet material is provided with on the side directed to the package inside, is stretching over the final edge of the tongue part 9 and even that one becoming liquidtight. For not doubling the thickness of this tongue part 9 by means of this folding 11 at that point the material has been scraped off to about half the size at this point. This is a conventional technique.

Figure 2:
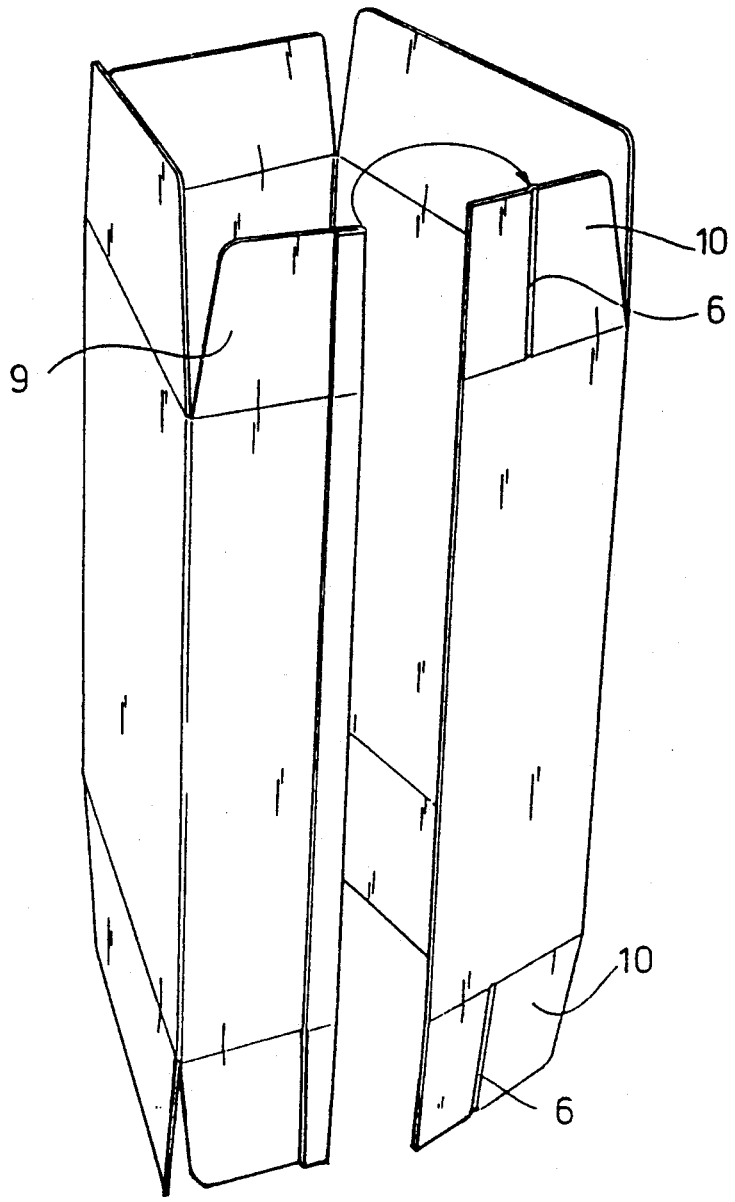
FIG. 2 is a perspective view of the folding of a blank for a sleeve.

The other tongue part 10 is provided with a folding edge 6 which in the embodiment shown is stretching over the tongue part 10 and incorporates the basic idea of the present invention. Naturally, this folding edge 6 can stretch along the whole wall portion, but this is not essential. The folding edge 6 is pressed in such a way that it protrudes from the general tongue part plane 10 on that side, where the liquidtight layer is situated and on which de first mentioned tongue part 9 is to be fastened. During the folding in accordance with FIG. 2 wax or glue is applied into the lapping joint 7 before it is pressed together, the final edge of the folding 11 being put into place at the side joning the folding edge 6. Alternatively the lapping joint can be heated in connection with the compression so that the plastic material of the sheetlike blank is melting and provides for the desired attachment. At this stage the future package has the form of a tubular sleeve, in which form it is fed into the filling and sealing machine.

The sealing of a package is usually performed by first sealing the bottom and, after filling, the lock, but a reverse procedure is also possible. For achieving a liquidtight and airtight sealing of the package this is at least at one end of the package achieved by means of the method according to the present invention.

Figure 3:
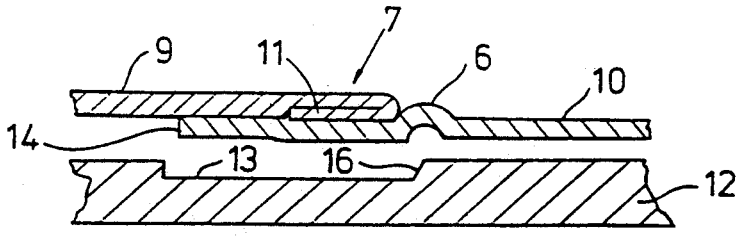
FIGS. 3 and 4 are schematic, partly cut cross sections for performing a folding according to the invention.
Figure 4:
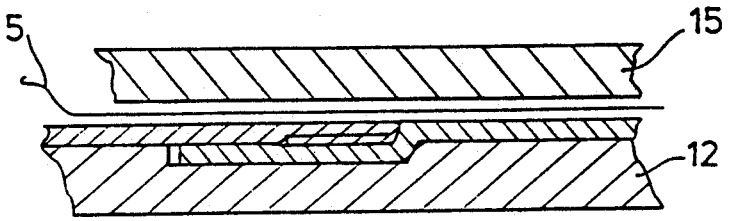
Figure 5:
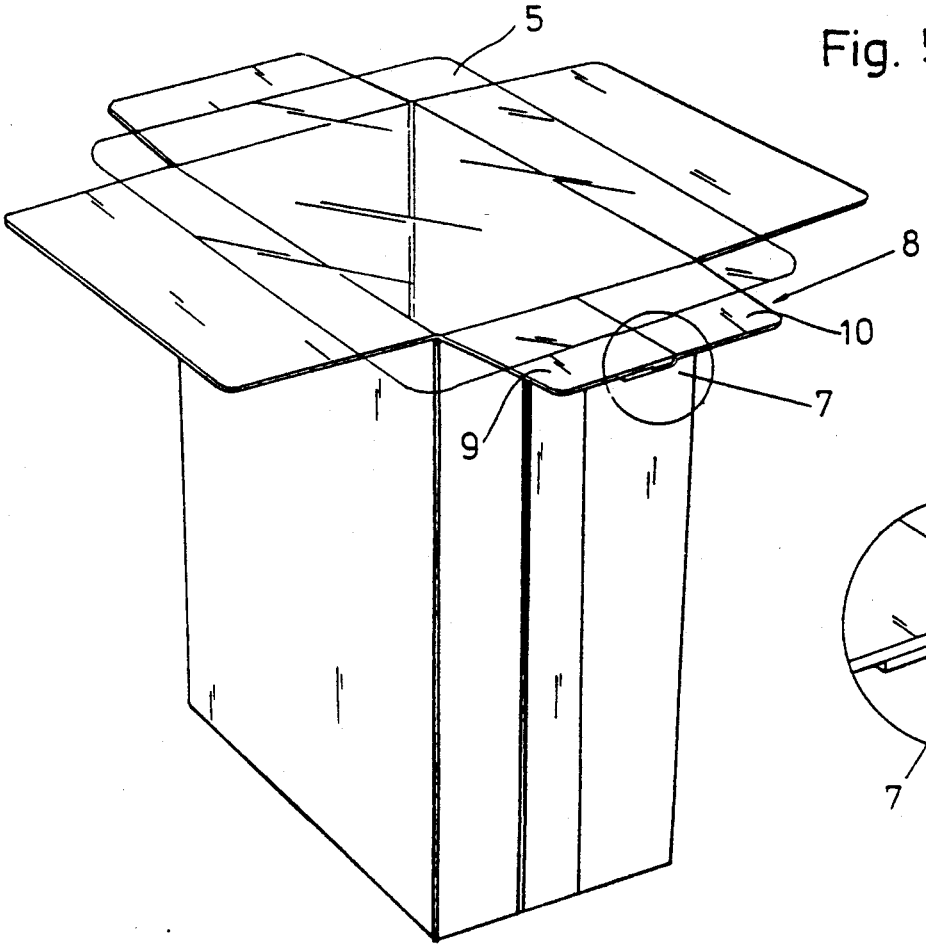
FIG. 5 is a perspective view of a package being achieved according to the invention, a part of the joint being shown in detail.
Figure 6:
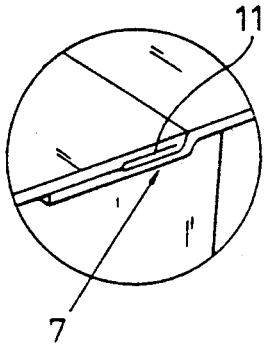
FIG. 6 is an enlarged view of the circled area depicted in FIG. 5.

After manufacturing the sleeve all its end tongues are folded outwards in the end of the package to be sealed, generally perpendicular to the sleeve sides to engage the counterstays, of which one, 12, is shown in FIGS. 3 and 4. The counterstays are plane with exception of where the lapping joints 7 are situated, where the counterstay 12 is provided with a recess 13 with a width generally corresponding to the distance between the folding edge 6 and the final edge 14 of the tongue part 10. The lapping joint 7 can be placed in a psoition on top of this recess 13. Thereafter, a foil 5 is placed over the open end, e.g. after the package has been filled with its product, and partly over the end tongues in accordance with FIG. 5. Thereafter, a heating plate 15 is pressing the foil 5 against the folding tongues and the corners. The lapping joint 7 is thereby pressed down into the recess 13, as schematically shown in FIG. 4. The consequence thereof is, that the two tongue parts 9, 10 will be lying in the same plane on that side, on which the foil 5 is provided, and the heatring plate 15 is then melting the plastic layer, usually in polyethylene, existing on both the foil 5 and the sheetmaterial of the package so that both parts stick to each other and a completely tight package is obtained. The concave side of the folding edge 6 will at that moment being placed on top of the correponding edge 16 of the recess 13 lying underneath and by means of the pressure from the heating plate 15 the folding edge 6 is bent against the final edge of the folded portion 11 in engagement with it. The little cavity or channel which possibly can arise there is filled with the melted plastics lying on both the foil 5 and the tongue parts 8, 9 and any leakage from the lapping joint 7 will therefore not be obtained. By means of the guiding by pressing the tongue part 10 in between the edge 14 and the folding edge 6 a good security is obtained in the design of the joint 7 simultaneously with no need existing that the edge of the folded portion 11 has to engage the folding edge 6 all the way instead of only on one spot under the foil 5 for achieving a sealing barrier.

To provide a pressure regulation over the lapping joint 7 during pressing the recess 13 can have different depths and/or been provided with a pattern.

The present invention has achieved the object mentioned in the beginning. Anyone skilled in the art can see that the invention can be performed in many different ways. E.g. the folding edge for the lapping joint can have another porfile than the one shown before and the lapping joints can be provided on more than one of the folding tongues. The invention is not limitied either to packages with a square or a rectangular cross section. Such different embodiments are however anticipated to ly within the scope of the attached patent claims.

I claim:

1. A manufacturing method for a package in the form of a box which is air tight and liquid tight and contains contents such as liquids, the box being folded from a sheetlike blank to a tubular sleeve and assembled along a lapping joint, both a top and a bottom of said tubular sleeve having foldable tongues projecting from ends of walls of the tubular sleeve, of which at least one of the top and the bottom include a first tongue part and a second tongue part partly lapping each other, a folded edge being provided in the first tongue part, the second tongue part during folding and assembly of the sheetlike blank having an edge being placed joining the folded edge of said first tongue part, all tongue parts engaging counterstays projecting in essentially 90 degrees from the walls of the tubular sleeve, the lapping joint formed by said first tongue part and said second tongue part being placed over a recess in a counterstay, a covering foil stretching over an opening of the tubular sleeve and at least partly over the first tongue part and the second tongue part, a heating plate being pressed against the covering foil thereby pressing the covering foil against said first tongue part and said second tongue part and heating said covering foil to connect said covering foil to said first tongue part, said second tongue part and corner portions of said tubular sleeve, at least one portion of the lapping joint during pressing being pressed into the recess in the counterstay, the folded edge being bent against said edge of said second tongue part.

* * * * *